US010086407B2

(12) United States Patent
Sauser

(10) Patent No.: US 10,086,407 B2
(45) Date of Patent: Oct. 2, 2018

(54) VIBRATING SCREEN DECK DEFLECTOR SYSTEMS AND METHODS

(71) Applicant: TEREX USA, LLC, Westport, CT (US)

(72) Inventor: Edwin J Sauser, Monticello, IA (US)

(73) Assignee: TEREX USA, LLC, Westport, CT (US)

( * ) Notice: Subject to any disclaimer, the term of this patent is extended or adjusted under 35 U.S.C. 154(b) by 0 days.

(21) Appl. No.: 14/936,161

(22) Filed: Nov. 9, 2015

(65) Prior Publication Data

US 2016/0059266 A1 Mar. 3, 2016

Related U.S. Application Data

(63) Continuation of application No. 14/011,361, filed on Aug. 27, 2013, now Pat. No. 9,205,459.

(60) Provisional application No. 61/693,819, filed on Aug. 28, 2012.

(51) Int. Cl.
*B07B 1/28* (2006.01)
*B07B 13/16* (2006.01)

(52) U.S. Cl.
CPC ..... *B07B 1/28* (2013.01); *B07B 13/16* (2013.01); *B07B 2201/04* (2013.01)

(58) Field of Classification Search
CPC ..... B07B 1/28; B07B 13/16; B07B 2201/04
USPC ..... 209/315, 363, 309, 311, 364
See application file for complete search history.

(56) References Cited

U.S. PATENT DOCUMENTS

| | | | | |
|---|---|---|---|---|
| 1,866,171 | A * | 7/1932 | Pavone | B07B 1/286 209/315 |
| 3,322,354 | A * | 5/1967 | Ostermann | B28C 7/0007 209/315 |
| 4,322,288 | A * | 3/1982 | Schmidt | B02B 1/02 209/240 |
| 4,576,713 | A | 3/1986 | Melin | |
| 5,199,574 | A * | 4/1993 | Hollyfield, Jr. | B07B 1/42 209/315 |
| 5,749,471 | A | 5/1998 | Andersson | |
| 6,889,846 | B2 * | 5/2005 | Olsen | B07B 1/46 209/309 |
| 7,971,817 | B1 | 7/2011 | Rossi | |
| 8,556,083 | B2 * | 10/2013 | Burnett | B01D 33/0376 209/315 |
| 8,636,150 | B1 * | 1/2014 | Akers, Jr. | B07B 1/282 209/314 |
| 9,079,222 | B2 * | 7/2015 | Burnett | B01D 33/0376 |
| 2004/0050757 | A1 * | 3/2004 | Anibas | B07B 1/343 209/309 |
| 2013/0181075 | A1 | 7/2013 | Pickens et al. | |

* cited by examiner

*Primary Examiner* — Terrell Howard Matthews
(74) *Attorney, Agent, or Firm* — Simmons Perrine Moyer Bergman PLC

(57) ABSTRACT

A material processing vibrating screen with diverting systems configured to deliver material, via a plurality of material diverters, to locations closer to a feed end of the screen than would otherwise be done in the absence of the diverters. The diverters can be fixed to a cross member, the underside of a screen, and may be adjustable and easily replaceable. The materials for the deflectors can vary depending upon the material being screened. The screen may be also be a variable sloped vibrating screen.

11 Claims, 2 Drawing Sheets

VIBRATING SCREEN DECK DEFLECTOR SYSTEMS AND METHODS

CROSS REFERENCE TO RELATED APPLICATIONS

This application claims the benefit of the non-provisional patent application having Ser. No. 14/011,361 filed Aug. 27, 2013 and of the filing date of the provisional patent application having Ser. No. 61/693,819 filed Aug. 28, 2012.

The contents of these applications are incorporated herein in their entirety by these references.

BACKGROUND OF THE INVENTION

This invention relates to vibrating screens.

The aggregate industry utilizes many styles of screen machines to sort aggregates by size. Most screen machines utilize vibration to agitate the mixture of aggregates to promote separation through various sized openings in the screening surfaces. Sorting is achieved by undersized particles passing through the openings in the screening surface and the oversized particles being retained above the screen surface. These machines usually have some type of vibrating mechanism to shake the unit and its screening surfaces. The vibrating mechanisms usually include an unbalanced weight mounted on one, or several, rotating shafts which, when rotated, force a cycling motion into the screen machine.

Sometimes a screen is designed with several layers, or decks, of screening surfaces which have screen media of various sized openings to allow sorting of granular material, which is fed into the machine, into several discreet particle sizes. These layers may be herein referred to as decks or screens.

The screen surface media normally consists of a wire mesh or flexible panel with punched or formed holes, all of which have specific sized openings to allow passage of sized particles to the decks below, or out the bottom of the screen. The larger sized particles are retained above the surface and are usually discharged on the end opposite the feed end of the deck.

The screen media is normally sized with larger holes in the upper decks and smaller holes in the lower decks. A mixture of granular material, comprised of a variety of sized particles, is fed onto the top deck, which normally has the largest holes. Material smaller than the holes then falls through to the next level, while the material larger than the holes is retained on the deck. The material that has fallen through the holes settles onto the next lower deck. The next lower deck normally has smaller holes than the deck directly above. The material that is smaller than the hole falls through this deck while the material larger than the hole is retained, thus leaving a very specific size of material on this deck, smaller than the deck holes above, larger than the deck holes below. This is then repeated on lower decks depending on how many decks are employed in the screen machine. There can be many deck levels depending on how many different sized materials are desired from the machine.

For a continuous screening machine, the motion of the screen normally propels the material from one end of the screen known as the feed end, toward the opposite end known as the discharge end. Material can be continuously fed onto the feed end of the top most deck and as it flows across and down through the decks, various sized material are ejected from the discharge end of each sizing deck.

As the material travels down the decks, and until the undersized material (smaller than the holes) falls through the holes, there is some lag time until the particles can align and fall through the holes. The lag time before material starts hitting the lower deck reduces the effective screening surface of the lower deck. The industry normally assumes a lag time effect, i.e. an approximate reduction of 10% of the screening surface per deck level when computing the theoretical capacity of passing material through a deck. For example, if a top deck is 4' wide and 10' long from feed end to discharge end, the effective size is 4×10=40 square feet of screen surface on that deck. The next lower deck, assuming 10% reduction attributable to the lag time effect, the effective screen surface on this deck is (1-.1)×4×10=36 square feet. Again, for a third deck, the effective screen area is (1-.1-.1)×4×10=32 square feet.

Consequently, there is a need for improvement in sorting systems for multi-deck vibrating screens.

SUMMARY OF THE INVENTION

More specifically, an object of the invention is to provide an effective vibrating screen for use of multiple decks.

It is a feature of the present invention to include a deflector located between decks of a multiple deck screen.

It is an advantage of the present invention to reduce amount of the lag time effect.

It is another feature of the present invention to multiple deflectors attached to the underside of a single screen.

It is another advantage of the present invention to increase the uniformity of material depth across the lower screen.

It is still another feature of the present invention to include adjustable deflectors in both length and angular orientation.

It is still another advantage of the present invention to selectively determine the amount of material to be diverted by adjusting the deflector.

The present invention includes the above-described features and achieves the aforementioned objects.

Accordingly, the present invention comprises a vibrating screen with a material deflector attached below one screen and above another screen, for carrying the material closer to a feed end of the screen.

BRIEF DESCRIPTION OF THE DRAWINGS

The invention may be more fully understood by reading the following description of the preferred embodiments of the invention, in conjunction with the appended drawings wherein.

DETAILED DESCRIPTION

Figure 1:
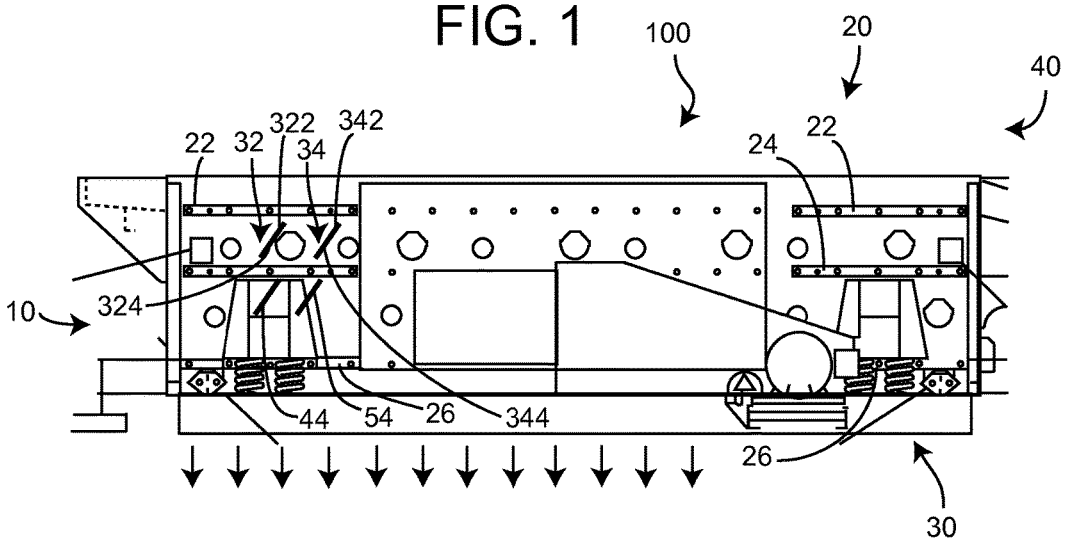
FIG. 1 is an elevation view of a material processing system of the present invention.

Now referring to the drawings wherein like numerals refer to like matter throughout, and more specifically referring to FIG. 1, there is shown an elevation view of a material processing system of the present invention, generally designated 100, which has a feed end 10, top side 20, bottom side 30 and discharge end 40. The multi-deck screen 100 is shown in a horizontal orientation. It should be understood that the present invention is not limited to horizontal screens and indeed some of the beneficial aspects of the invention are especially helpful when the screen 100 is inclined. The mechanism for inclining the screen is well known in the prior art. Inside of screen 100 is top screen 22, middle screen 24 and bottom screen 26. The screen 100 is shown with side panels at the feed end 10 and the discharge end 40 removed so as to reveal the inner structures. Top screen 22 is shown with two diverters 32 and 34 attached thereto. In some embodiments, these might be considered optional and might be removed. These diverters 32 and 34 are shown as being optionally adjustable in length via overlapping or telescoping sections 322, 324 and 342, 344 respectively. The adjustable nature of the diverters is especially helpful when the screen 100 is a variable slope screen which is readily varied. These could pivot below the top screen 22. These angular and length adjustable diverters might bear some general resemblance to the flaps on an aircraft wing and might employ some manual mechanical or automated electronic or hydraulic remote controlled mechanism for making the adjustments. Automation of diverter adjustment which is dependent upon a variable screen slope orientation may be helpful in some applications.

Diverters 44 and 54 are shown disposed beneath the middle screen 24 and are shown as fixed in length and orientations. It should be understood that these diverters also could be adjustable in angular orientation and length similar to diverters 32 and 34.

Figure 2:
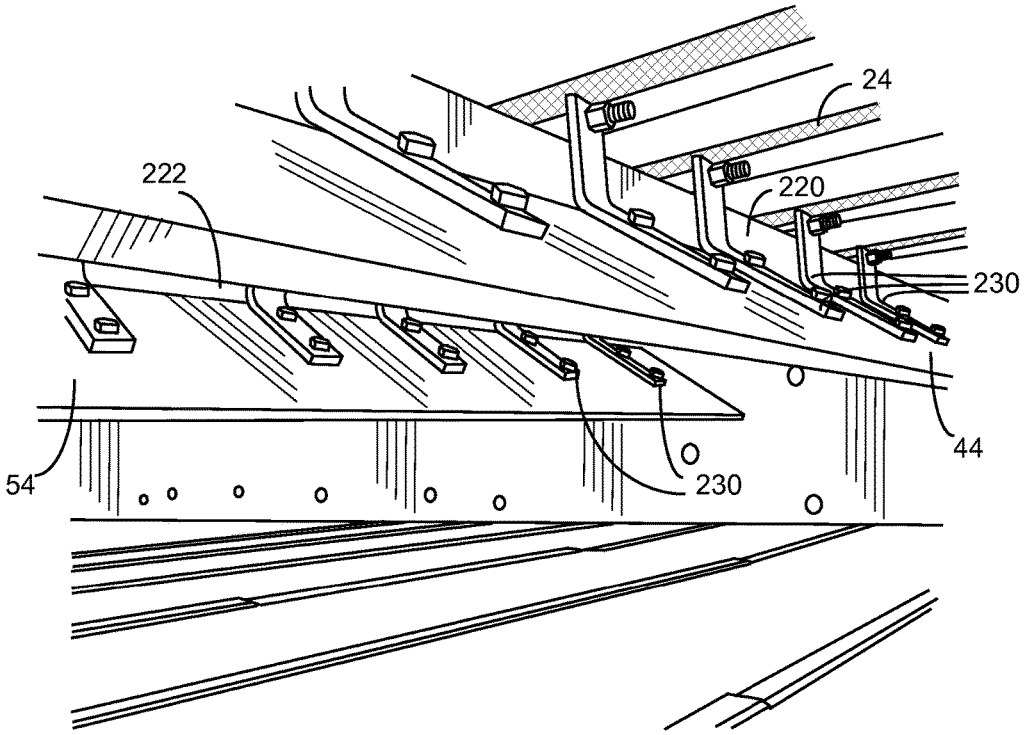
FIG. 2 is a perspective internal view of the system of FIG. 1 looking from the feed end toward the discharge end.

Now referring to FIG. 2, there is shown a view of an insider portion of the screen 100 of FIG. 1 looking from the feed end 10 in a direction toward the discharge end 40. There is shown a cross support beam 220 and a second cross support beam 222. These beams support angled brackets 230, which help to hold the diverters 44 and 54 respectively below the middle screen 24 and bottom screen 26. The curved arrows in FIG. 2 represent the direction of flow of material.

The lag time effect can be reduced or eliminated by employing the system of deflectors, 32, 34, 44, and 54.

A thinner bed depth reduces the carry of small material on the bed of material, allowing it to contact the screening surface sooner, which improves the efficiency of that deck.

Figure 3:
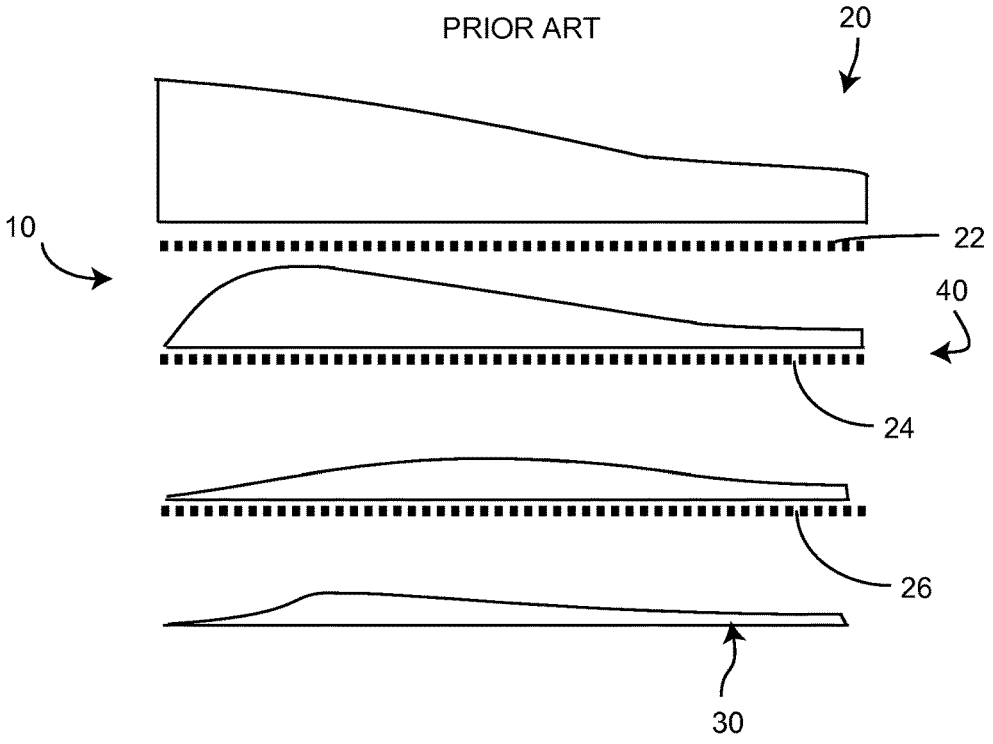
FIG. 3 PRIOR ART
FIG. 3 is a graphic view of a material depth characteristic of a prior art screen.

FIG. 3 shows normal material distribution on a prior art 3 deck screen.

Figure 4:
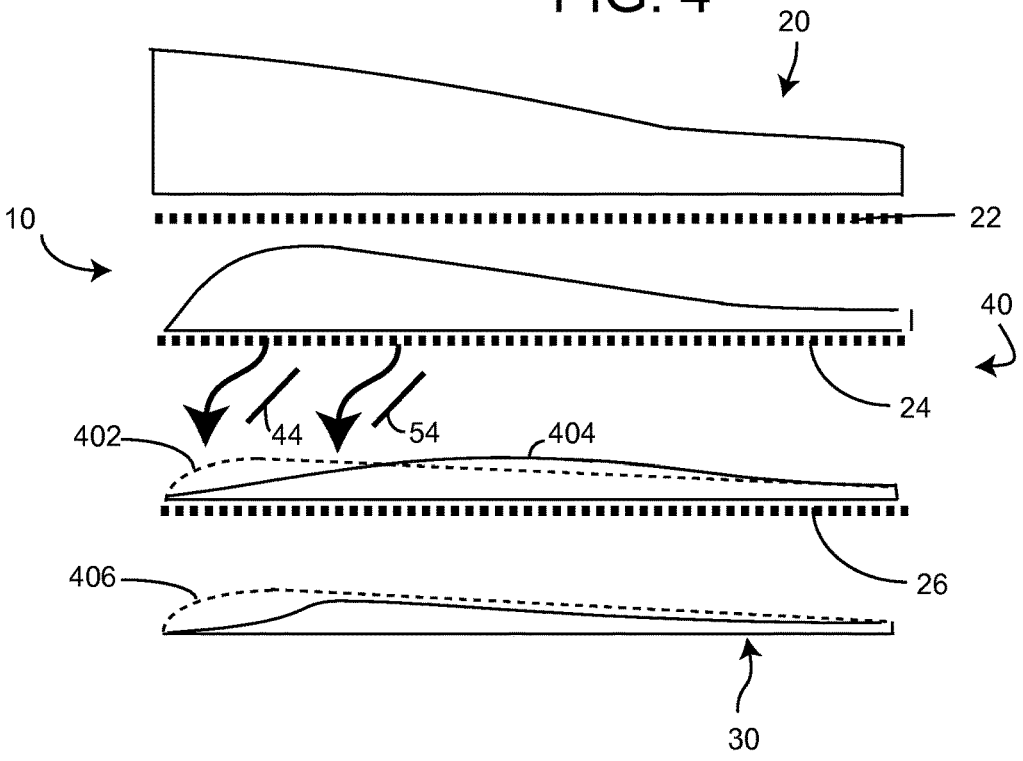
FIG. 4 is a graphic view of a material depth characteristic of a screen of the present invention and system and configuration as shown in FIGS. 1 and 2, where the dotted lines refer to the material depth of FIG. 3.

FIG. 4 shows the difference using the deck deflectors 44 and 54 to divert the material toward the feed end of the lower deck 26. Dotted material depth lines in FIG. 4 are the same as the solid material depth lines in FIG. 3. This helps to show the positive aspects of the present invention. Area 402 is material which has been shifted forward or toward the feed end 10 and the gap in the middle and section between the dotted and solid material depth lines represents the reduction in maximum bed depth. The area 406 shows the increased material at the feed end 10.

By using the diverters 32, 34, 44, and 54 the effective surface area of the lower screens is increased. This allows for one or more of increased efficiency of operation, more precise control of homogeneity of material being output at the discharge ends of each of the lower decks (fewer particles in a discharge end of a screen which are smaller than that screen size).

It is thought that the method and apparatus of the present invention will be understood from the foregoing description and that it will be apparent that various changes may be made in the form, construct steps, and arrangement of the parts and steps thereof, without departing from the spirit and scope of the invention or sacrificing all of their material advantages. The form herein described is merely a preferred exemplary embodiment thereof.

I claim:

1. A material products processing vibrating screen mechanism comprising:

a multi-deck vibrating screen assembly, having an upper deck, a lower deck, a feed end and a discharge end and a common downwardly directed material flow direction across the top of said upper deck and across the top of said lower deck from said feed end to said discharge end;

a first material diverter disposed between said upper deck and said lower deck sized, configured and located for directing a flow of material, which has passed through holes in the upper deck, in a direction vector which has a component counter to the material flow direction across said upper deck; and a second material diverter wherein said first material diverter and said second material diverter are located in a gap between said upper deck and said lower deck, in which no other decks are disposed; wherein said second material diverter is located downstream from and parallel to said first material diverter and thereby closer to said discharge and said lower deck, in which no other decks are disposed; wherein said second material diverter is located downstream from and parallel to said first material diverter and thereby closer to said discharge end than is said first material diverter; and wherein said multi-deck vibrating screen assembly is oriented at an inclined angle with respect to the horizontal.

2. The mechanism of claim 1 wherein said first material diverter is located so that a resultant maximum depth of material on said lower deck is reduced with respect to a maximum depth of material on the lower deck in an absence of such first material diverter.

3. The mechanism of claim 1 wherein said first material diverter is coupled to a first support member, which spans a width of said lower deck, said material diverter is located said upper deck.

4. The mechanism of claim 1 wherein said material diverter is adjustable in angular orientation and in length.

5. The mechanism of claim 1 wherein said material diverter is flexible.

6. A multi-deck vibrating screen comprising:

an upper deck;

a lower deck; disposed below the upper deck with a uniform separation distance therebetween;

a feed end and a discharge end and a downwardly directed material flow direction across said upper deck and said lower deck from said feed end to said discharge end;

a plurality of flow diverting means disposed between said upper deck and said lower deck, configured and located for directing a flow of material, which has passed through holes in the upper deck, in a direction vector which is counter to the material flow direction across the upper deck and the lower deck and configured so that a resultant maximum depth of material on said lower deck is reduced with respect to a maximum depth of material on the lower deck in an absence of such plurality of material diverters;

an intermediate deck disposed between said upper deck and said lower deck in a parallel configuration and said plurality of flow diverting means being disposed in a gap between said upper deck and said intermediate deck, with no other decks disposed in said gap;

a lower material deflector disposed between said intermediate deck and said lower deck and configured to divert material which was previously diverted by said plurality of flow diverting means;

a lower material deflector disposed between said intermediate deck and said lower deck and configured to divert material which was previously diverted by said plurality of flow diverting means;

wherein said plurality of flow diverting means is a plurality of upper material deflectors coupled below said upper deck;

and wherein said plurality of upper material deflectors are adjustable in angular orientation and length.

7. A method of sorting material into predetermine particle size range groups comprising the steps of:

providing a multi-deck vibrating screen having:

an upper deck; a lower deck; a feed end; a discharge end;

an upper downwardly directed material flow direction across a top side of said upper deck from said feed end to said discharge end; and a lower downwardly directed material flow direction across a top side of said lower deck from said feed end to said discharge end; using a first material diverter disposed between upper deck and said lower deck to prohibit material from otherwise passing through the upper deck and immediately contacting the lower deck which is adjacent to the upper deck, and instead causing a redirection to a location thereon which is closer to a feed end of said multi-deck vibrating screen than said material would have if no such first material diverter were used; and using a second a second material diverter disposed between an upper deck and said lower deck to prohibit material from otherwise passing through the upper deck and immediately contacting the lower deck which is adjacent to the upper deck and instead causing a redirection to a location thereon which is closer to a feed end of said multi-deck vibrating screen than said material would have if no such second material diverter were used; wherein said second material diverter is located downstream from and parallel to said first material diverter and thereby closer to said discharge end than is said first material diverter.

8. The method of claim 7 further comprising the steps of:

changing a slope characteristic of said multi-deck vibrating screen; and wherein said step of using a first material diverter comprises the steps of automatically adjusting one of an angular orientation and length of said first material diverter to change a distribution pattern of material contacting said next lower deck, where an input into controlling the orientation and length is dependent upon said slope characteristic of the multi-deck vibrating screen.

9. The method of claim 7 further comprising the steps of augmenting said material diverter with a supplemental material diverter to change a distribution pattern of material contacting said next lower deck.

10. A method of claim 7 wherein said multi-deck vibrating screen is oriented in a substantially non-inclined plane.

11. A method of claim 7 wherein said step of using a first material diverter further performs the function of reducing an amount of fines material which passes through two adjacent decks in a substantially vertical path.

* * * * *